US008828160B2

(12) United States Patent
Kremmer et al.

(10) Patent No.: US 8,828,160 B2
(45) Date of Patent: Sep. 9, 2014

(54) METHOD FOR PRODUCING A FORGING FROM A GAMMA TITANIUM ALUMINUM-BASED ALLOY

(75) Inventors: Sascha Kremmer, Kraubath (AT); Heinz Romen-Kierner, Bruck a.d. Mur (AT); Wilfried Wallgram, Leoben (AT)

(73) Assignee: Boehler Schmiedetechnik GmbH & Co. KG., Kapfenberg (AT)

( * ) Notice: Subject to any disclaimer, the term of this patent is extended or adjusted under 35 U.S.C. 154(b) by 782 days.

(21) Appl. No.: 12/793,410

(22) Filed: Jun. 3, 2010

(65) Prior Publication Data

US 2010/0329877 A1 Dec. 30, 2010

(30) Foreign Application Priority Data

Jun. 5, 2009 (AT) ..... 879/2009

(51) Int. Cl.
*C22F 1/18* (2006.01)

(52) U.S. Cl.
USPC ..... 148/670; 148/671; 72/342.1

(58) Field of Classification Search
USPC ..... 72/342.1, 342.7–342.92; 148/668–671
See application file for complete search history.

(56) References Cited

U.S. PATENT DOCUMENTS

| | | | | |
|---|---|---|---|---|
| 1,849,185 | A | 3/1932 | Giacchino | |
| 5,054,301 | A | 10/1991 | Soga et al. | |
| 5,190,603 | A * | 3/1993 | Nazmy et al. | 148/671 |
| 5,299,353 | A * | 4/1994 | Nazmy et al. | 29/889.7 |
| 6,354,001 | B1 | 3/2002 | Asanuma | |

FOREIGN PATENT DOCUMENTS

| | | |
|---|---|---|
| DE | 4016339 | 8/1994 |
| DE | 4416471 | 11/1995 |
| DE | 4016340 | 5/1997 |
| DE | 102005022506 | 11/2006 |
| EP | 0781612 | 7/1997 |
| EP | 1127953 | 8/2001 |
| FR | 1086289 | 2/1955 |
| GB | 901251 | 7/1962 |
| JP | 9327746 | 12/1997 |

OTHER PUBLICATIONS

Zhang et al., "Hot work processing, microstructure and mechanical properties of two-phase gamma titanium aluminides", Materials Science & Engineering, A;Structural Materials; Properties, Microstructure and Processing, A185(1-2), 17-24 Coden; MSAPE3; ISSN: 0921-5093, 1994, XP024348822.

(Continued)

*Primary Examiner* — Brian Walck
(74) *Attorney, Agent, or Firm* — Greenblum & Bernstein, P.L.C.

(57) ABSTRACT

Method for producing a forging from a gamma titanium aluminum-based alloy. The method includes heating at least a portion of a cylindrical or rod-shaped starting or raw material to a temperature of more than 1150° C. over a cross section of the at least a portion. The at least a portion corresponds to points at which the forging to be shaped has volume concentrations. The method also includes deforming the at least a portion through an applied force to form a biscuit having different cross sectional areas over a longitudinal extension of the biscuit, and finishing the forging through a second heating to a deformation temperature and at least one subsequent step.

18 Claims, 2 Drawing Sheets

(56) References Cited

OTHER PUBLICATIONS

Zhang, Jiulai et al., "Forging of beta-phase containing Gamma—TiA1 alloys", Structural Aluminides for Elevated Temperatures: Gamma Titanium and Other Metallic Aluminides, Proceedings of [A] Symposium Held During [the] TMS Annual Meeting & Exhibition, New Orleans, LA, United States, Mar. 9-13, 2008, 265-272. Editor(S): Kim, 2008, XP009138755.

Habel U et al,, "Processing, Microstructure and Tensile Properties of Gamma—Tial PM Alloy 395MM", Gamma, Titanium, Aluminides, Proceedings of a Symposium; 20030000, 2003, Seiten 297-304, XP008068139.

Search report from E.P.O., mail date is Sep. 28, 2010.

Austria Office action, mail date is Sep. 16, 2010.

Hansen, "Al-Ti Aluminum-Titanium," *Constitution of Binary Alloys*, 2nd Ed., McGraw-Hill Book Co., Inc., pp. 139-142 (1958).

* cited by examiner

Section A-A

Section B-B

METHOD FOR PRODUCING A FORGING FROM A GAMMA TITANIUM ALUMINUM-BASED ALLOY

CROSS-REFERENCE TO RELATED APPLICATIONS

The present application claims priority under 35 U.S.C. §119 of Austrian Patent Application No. A 879/2009, filed on Jun. 5, 2009, the disclosure of which is expressly incorporated by reference herein in its entirety.

BACKGROUND OF THE INVENTION

1. Field of the Invention

The invention relates to a method for producing a forging from a gamma titanium aluminum-based alloy.

2. Discussion of Background Information

Titanium aluminum-based alloys, which are essentially formed from intermetallic titanium aluminide, have a high melting point, low density, a high specific modulus of elasticity, good oxidation behavior, high specific tensile strength, and creep resistance in a temperature range from 600° C. to 800° C. Thus, these alloys meet the constantly increasing requirements for special materials such as, e.g., for components of the next generation of aircraft engines and internal combustion engines.

Titanium aluminide materials have not yet been optimized with respect to their alloy composition or with respect to their production and processing.

An alloy having a good workability, as well as balanced mechanical properties, can be produced by suitable heat treatments from the elements titanium, aluminum, niobium, molybdenum and boron. For this reason, it is referred to as a "TNM alloy" among experts.

Due to the intermetallic character of the titanium aluminide alloys, also optionally of the TNM materials, can be brittle in unsuitable deformation conditions. Because of this brittle behavior in such unsuitable deformation conditions, a production of forgings such as turbine blades is critical and usually associated with high waste rates.

Moreover, it is known to carry out a forged deformation under isothermal conditions. However, this requires a special high-temperature drop forge die with a protective gas atmosphere and, therefore, is expensive.

SUMMARY OF THE INVENTION

According to embodiments of the invention, the difficult and expensive processing of titanium aluminide materials can be improved to provide a method of the type generally described above for economical production.

In accordance with embodiments, a method can include a cylindrical or rod-shaped starting material or raw material being heated to a temperature of more than 1150° C. by electric current passage or by induction over the cross section in one or more steps at those points at which the forging to be shaped has volume concentrations. The starting material is deformed by force impingement, in particular, deformed by compression, to produce a biscuit with different cross sectional areas over the longitudinal extension that is finished as a blank in one or more subsequent steps in each case after a heating to deformation temperature, in particular, in a forming die.

The advantages achieved with the embodiments of invention are essentially to be seen in an economic provision of raw material with different cross sectional surfaces in the longitudinal extension. This results in favorable material flow conditions in the finishing of the forging. Although gamma titanium aluminum-based alloys have a high specific stiffness, it has been shown to be favorable to use a cylindrical or rod-shaped starting material heated by induction or, in particular, by direct current passage between clamping zones or contact zones on the rod to a temperature of more than 1150° C. Despite radiation from the surface, a distribution of the temperature through the cross section is embodied or formed uniformly due to this heating. This is evidently achieved because, through a skin effect, the specific current flow and thus the heat generation in the surface region are increased.

At room temperature, the alloy is composed mainly of gamma titanium aluminum and alpha-2 titanium aluminum, and has only an optionally low proportion of beta phase, which has ductile properties depending on the temperature. With a heating to more than 1150° C., and advantageously to more than 1250° C., the proportion of beta phase in the material is increased, which is the reason for an improvement in the deformability of the material.

With a compression, as mentioned above, with targeted and homogeneous heating over the cross section of the rod to a high temperature, a uniform and targeted volume concentration and a desired fine-grain structure of the same are achieved.

If more than one enlarged cross-section region of the rod is desired, a deformation by way of compression can subsequently be carried out at several points.

A biscuit or intermediate product, produced according to the above described embodiments of the invention, can now be finished after heating, for example, in a forging furnace, and, in particular, in a forming die, in one or more subsequent steps. A die filling can be advantageously carried out with lower material flow and/or material use due to the volume concentrations.

Because a transport of the biscuit or intermediate product from the heat furnace to the deformation apparatus with the tool or with a forming die includes time-consuming transfer routes, critical cooling of the surface region of the part to be formed may be caused. Therefore, according to embodiments, the method can advantageously include that the one or more subsequent steps for finishing the biscuit or the intermediate product include forming an at least partial coating on the surface with an agent that reduces the heat emission and thereby reduces the drop in surface temperature. Thus, the method can generally includes a heating of the biscuit or intermediate product to deforming temperature, a soaking, a transfer and a deformation of the same, in particular in a die.

It has been shown that a coating of the surface of the biscuit or intermediate product with an agent to reduce the heat emission with a thickness of greater than 0.1 mm clearly reduces a temperature loss of the edge zone in the unit of time. In this manner, a necessarily high deformation temperature of the workpiece in the surface region is retained while avoiding formation of cracks during a deformation.

According to the embodiments, the oxide phase acts as a heat-resistant insulation component, wherein one or more additive(s) or adhesion promoters with low proportions binds (bind) the oxide grains and holds (hold) them on the substrate. The liquid component(s) serves (serve) to homogenize the phases and to adjust a desired degree of liquidity for the homogeneous application onto the surface of the workpiece or part.

An agent in which the main component or oxide phase is composed of zirconium oxide with a proportion in % by weight of greater than 70, preferably of 80 to 98, in particular of 90 to 97, has proven to be particularly favorable with respect to a major reduction of the heat emission.

In a further embodiment of the invention, a method can be advantageously performed to produce a forging free from defects in which the final deformation is carried out in a die that has a temperature at least 300° C. lower than the biscuit or the intermediate product. Simplifications in terms of installation engineering are thereby achieved with improved cost-effectiveness.

Further, a method according to the invention in which the final deformation is carried out in a die that has a temperature up to 900° C., preferably up to 800° C., lower than the biscuit or the intermediate product, intensifies the above advantages, because such a low tool temperature permits a use of conventional hot-forming steels for heat-treated dies, without a danger of the drop in hardness in the same in operation.

A method in which the final deformation is carried out as a quick deformation, with a deformation speed of greater than 0.3 mm/sec, in particular 0.5 to 5 mm/sec, provides advantages in terms of forging technology, as well as a much improved microstructure of the forging.

The method can be used advantageously for a production of turbine blades, e.g., of a TNM alloy.

The embodiments of the invention are directed to a method for producing a forging from a gamma titanium aluminum-based alloy. The method includes heating at least a portion of a cylindrical or rod-shaped starting or raw material to a temperature of more than 1150° C. over a cross section of the at least a portion. The at least a portion corresponds to points at which the forging to be shaped has volume concentrations. The method also includes deforming the at least a portion through an applied force to form a biscuit having different cross sectional areas over a longitudinal extension of the biscuit, and finishing the forging through a second heating to a deformation temperature and at least one subsequent step.

According to embodiments, the heating can be achieved through electric current passage or electric induction.

According to other embodiments of the invention, the heating may be performed in one or more steps.

Further, the application of force can include force impingement. The force impingement may include compression.

In accordance with other embodiments, the second heating can occur while the biscuit is in a forming die.

Moreover, the at least one subsequent step can include at least partially coating a portion of the surface with an agent that reduces heat emission and thereby a drop in surface temperature, and a soaking and deformation of the biscuit. The soaking and deformation may occur while the biscuit is in a die. Further, the agent that reduces the drop in surface temperature can include an oxide phase as a main component, at least one adhesive as an additive, and liquid components. Further, the agent can include zirconium oxide with a proportion in % by weight of greater than 70, may be 80 to 98, and can be 90 to 97.

According to still other embodiments, the at least one subsequent step can include a final deformation carried out in a die that has a temperature at least 300° C. lower than the biscuit.

Further, the at least one subsequent step may include a final deformation carried out in a die that has a temperature up to 900° C. lower than the biscuit. The die can have a temperature of up to 800° C. lower than the biscuit.

According to still other embodiments of the instant invention, the at least one subsequent step may be carried out as a quick deformation at a deformation speed of greater than 0.3 mm/sec., and can be between 0.5 and 5 mm/sec.

In accordance with other embodiments, the forgings may be used in the production of turbine blades.

According to further embodiments, a turbine blade can be formed according to the above-described method.

In accordance with still yet other embodiments of the present invention, the turbine blade can include a Ti-43.5Al—(Nb—Mo—B) 5 atomic % alloy.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
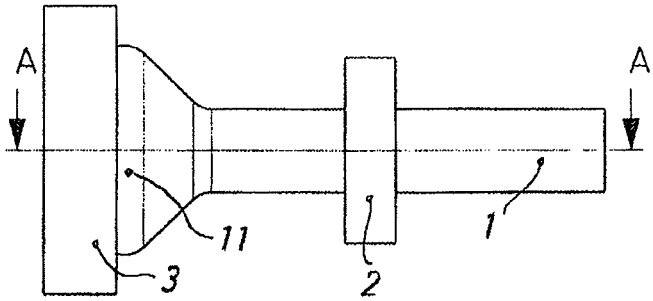
FIG. 1 illustrates a view free compression of a rod end.
Figure 2:
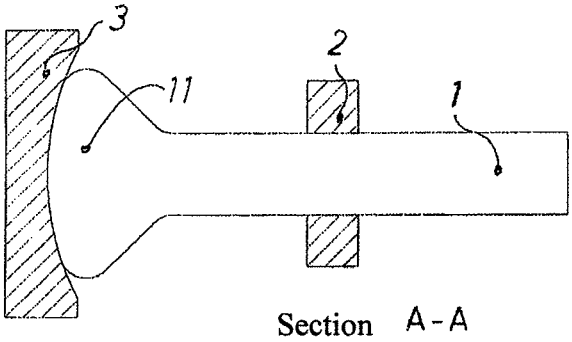
FIG. 2 illustrates an axial section view of the free compression of a rod end as depicted in FIG. 1.

FIGS. 1 and 2 show a compression of a rod 1 with free spreading.

A power source (not shown) is connected to a terminal 2 and a flat die 3 shaped in a slightly concave manner. For a deformation, a rod 1 is pressed in a press against flat die 3. Electric current flows between flat die 3 and terminal 2, which in this area heats the rod through ohmic resistance.

A heating of a rod or a rod part can also be carried out by an inductance coil and alternating current.

A compression of a rod end, in the given case with free spreading, takes place through a compression force after heating of a rod part.

It has been shown that titanium aluminum-based alloys have particularly good compression properties and do not tend to buckle. Furthermore, a rapid, targeted soaking of a rod area is possible through a thermal technology with electric current passage or through induction. In this way, a precise adjustment of the deformation temperature can be achieved in the so-called workability window of the alloy.

Figure 3:
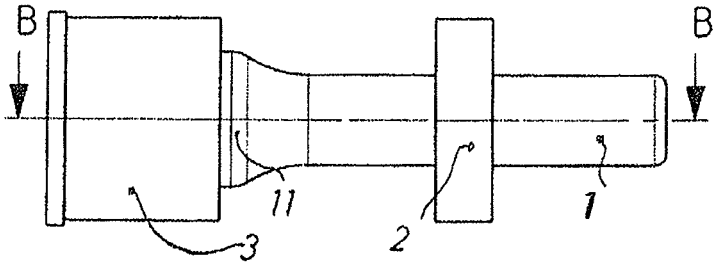
FIG. 3 illustrates a view of a compression of a rod end in a mold.
Figure 4:
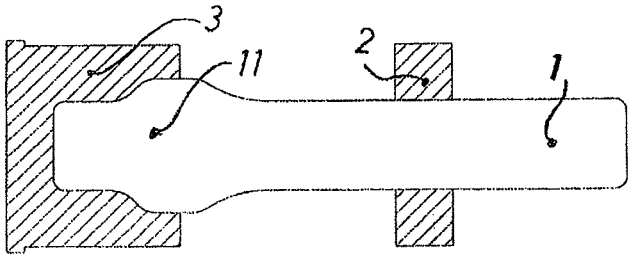
FIG. 4 illustrates an axial section view of a compression of a rod end in a mold as depicted in FIG. 1.

FIG. 3 and FIG. 4 show a compressing-in of an end of a rod 1 in a mold 3 with the formation of an end region 11 formed as desired.

In this manner, a precise dimension of a biscuit for a final shaping can be produced.

Blanks as shown diagrammatically in FIG. 3 and FIG. 4 were produced for turbine blade forging from a rod with a diameter of 30 mm Ø and a length of 225 mm composed of a Ti-43.5Al—(Nb—Mo—B) 5 atomic % alloy. The production length was 192 mm with a head diameter of 45 mm and a head length of 63 mm.

The heating and compression time was 60 seconds. A filament power with 7740 A and a deformation temperature of 1250° C. had been adjusted.

Figure 5:
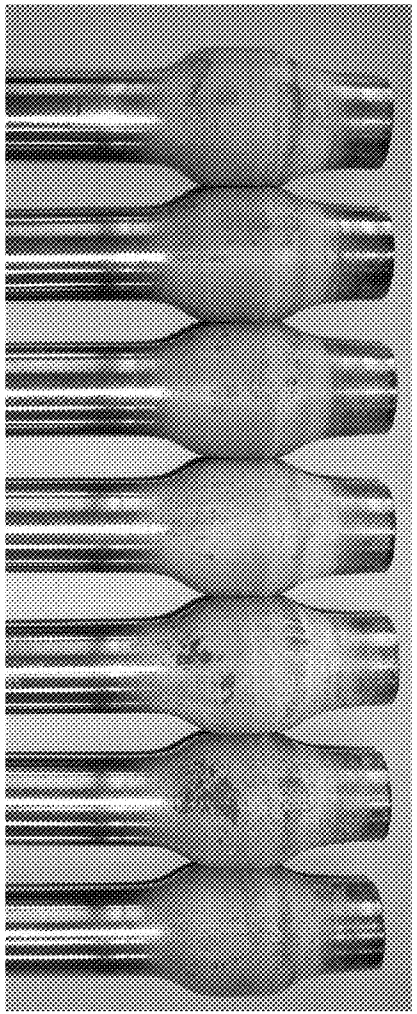
FIG. 5 illustrates end regions of rods of a Ti Al-based alloy or starting material for a die forging compressed in a mold.

FIG. 5 shows blanks compressed in a mold.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for producing a forging from a gamma titanium aluminum-based alloy, comprising:

heating at least a portion of a cylindrical or rod-shaped starting or raw material to a temperature of more than 1150° C. over a cross section of the at least a portion, the at least a portion corresponding to points at which the forging is to be shaped;

deforming the at least a portion through an applied force to form a biscuit having different cross sectional areas over a longitudinal extension of the biscuit;

at least partially coating a surface of the deformed at least a portion with an agent that reduces heat emission to achieve a drop in surface temperature; and finishing the forging through at least a second heating to a deformation temperature.

2. The method in accordance with claim 1, wherein the heating is achieved through electric current passage or electric induction.

3. The method in accordance with claim 1, wherein the heating is performed in one or more steps.

4. The method in accordance with claim 1, wherein the applied force comprises force impingement.

5. The method in accordance with claim 4, wherein the force impingement comprises compression.

6. The method in accordance with claim 1, wherein the second heating occurs while the biscuit is in a forming die.

7. A method for producing a forging from a gamma titanium aluminum-based alloy, comprising:

heating at least a portion of a cylindrical or rod-shaped starting or raw material to a temperature of more than 1150° C. over a cross section of the at least a portion, the at least a portion corresponding to points at which the forging is to be shaped;

deforming the at least a portion through an applied force to form a biscuit having different cross sectional areas over a longitudinal extension of the biscuit; and finishing the forging through at least:

a second heating to a deformation temperature, at least partially coating a portion of the surface with an agent that reduces heat emission to achieve a drop in surface temperature, and soaking and deforming the biscuit.

8. The method in accordance with claim 7, wherein the soaking and deformation occurs while the biscuit is in a die.

9. The method in accordance with claim 7, wherein the agent that reduces the drop in surface temperature comprises an oxide phase as a main component, at least one adhesive as an additive, and liquid components.

10. The method in accordance with claim 7, wherein the agent comprises zirconium oxide with a proportion in % by weight of greater than 70.

11. The method in accordance with claim 10, wherein the % by weight of zirconium oxide is 80 to 98.

12. The method in accordance with claim 10, wherein the % by weight of the zirconium oxide is 90 to 97.

13. The method in accordance with claim 1, wherein finishing further comprises a final deformation carried out in a die that has a temperature at least 300° C. lower than the biscuit.

14. The method in accordance with claim 1, wherein finishing further comprises a final deformation carried out in a die that has a temperature up to 900° C. lower than the biscuit.

15. The method in accordance with claim 14, wherein the die has a temperature of up to 800° C. lower than the biscuit.

16. The method in accordance with claim 1, wherein the finishing further is carried out as a quick deformation at a deformation speed of greater than 0.3 mm/sec.

17. The method in accordance with claim 16, wherein the deformation speed is between 0.5 and 5 mm/sec.

18. A method for producing turbine blades comprising:

producing a forging from a gamma titanium aluminum-based alloy by:

heating at least a portion of a cylindrical or rod-shaped starting or raw material to a temperature of more than 1150° C. over a cross section of the at least a portion, the at least a portion corresponding to points at which the forging is to be shaped;

deforming the at least a portion through an applied force to form a biscuit having different cross sectional areas over a longitudinal extension of the biscuit;

at least partially coating a surface of the biscuit with an agent that reduces heat emission to achieve a drop in surface temperature;

finishing the forging through at least a second heating to a deformation temperature; and producing turbine blades from the forgings.

* * * * *